US009513094B2

(12) United States Patent
Dierks et al.

(10) Patent No.: US 9,513,094 B2
(45) Date of Patent: Dec. 6, 2016

(54) AMMUNITION WITH PROJECTILE CONTAINING NO EXPLOSIVE MATERIAL IN ORDER TO CREATE A MULTI-SPECTRAL TARGET SIGNATURE

(71) Applicant: Rheinmetall Waffe Munition GmbH, Unterluss (DE)

(72) Inventors: Lars Dierks, Kiel (DE); Christopher Zimmermann, Hamburg (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 0 days.

(21) Appl. No.: 14/098,106

(22) Filed: Dec. 5, 2013

(65) Prior Publication Data

US 2014/0305328 A1 Oct. 16, 2014

Related U.S. Application Data

(60) Provisional application No. 61/760,819, filed on Feb. 5, 2013.

(30) Foreign Application Priority Data

Dec. 5, 2012 (DE) ..... 10 2012 023 700

(51) Int. Cl.

| | |
|---|---|
| ***F42B 12/46*** | (2006.01) |
| ***F42B 12/40*** | (2006.01) |
| ***F42B 12/44*** | (2006.01) |
| ***F42B 12/52*** | (2006.01) |
| ***F42C 19/00*** | (2006.01) |
| ***F42C 99/00*** | (2006.01) |

(52) U.S. Cl.

CPC ..... *F42B 12/46* (2013.01); *F42B 12/40* (2013.01); *F42B 12/44* (2013.01); *F42B 12/52* (2013.01); *F42C 19/00* (2013.01); *F42C 99/00* (2013.01)

(58) Field of Classification Search

CPC ..... F42B 12/44; F42B 12/46; F42B 12/52
USPC ..... 102/363
See application file for complete search history.

(56) References Cited

U.S. PATENT DOCUMENTS

| | | | | |
|---|---|---|---|---|
| 2,342,112 A * | 2/1944 | Bencal | ..... | 102/365 |
| 2,374,230 A * | 4/1945 | Nicholas | ..... | 102/365 |
| 2,383,720 A * | 8/1945 | Hamilton | ..... | 102/365 |

(Continued)

FOREIGN PATENT DOCUMENTS

| | | |
|---|---|---|
| DE | 140572 | 10/1901 |
| DE | 25 58 836 A1 | 6/1977 |

(Continued)

OTHER PUBLICATIONS

Document received in corresponding German application 10 2012 023 700.6 on Oct. 31, 2013 citing references (no translation available).

*Primary Examiner* — Gabriel Klein
(74) *Attorney, Agent, or Firm* — Griffin and Szipl PC

(57) ABSTRACT

An ammunition is proposed with an explosive-free missile that releases, upon dismantling at the target a fuel or fuel mixture as flammable air-fuel mixture, being caused to spontaneously react by at least one, by impact dismantling triggered, explosive-free, spark-generating ignition mechanism. The thus produced optical and thermal target signature can be detected with the naked eye, as well as with rifle scopes or other optical target detection systems, as well as with night-vision and thermal imaging devices.

12 Claims, 4 Drawing Sheets

(56) References Cited

U.S. PATENT DOCUMENTS

| | | | | |
|---|---|---|---|---|
| 3,613,585 | A | 10/1971 | Dubroff | |
| 3,785,292 | A | 1/1974 | Bendler et al. | |
| 3,786,756 | A * | 1/1974 | Looger | 102/363 |
| 4,493,262 | A * | 1/1985 | Hutcheson | 102/363 |
| 7,055,438 | B1 | 6/2006 | Manole et al. | |
| 7,571,680 | B1 * | 8/2009 | Tafoya | 102/364 |
| 2005/0223930 | A1 * | 10/2005 | Bootes et al. | 102/473 |
| 2006/0081147 | A1 * | 4/2006 | Walsh | 102/368 |
| 2008/0202371 | A1 * | 8/2008 | Montefusco | 102/335 |
| 2011/0079164 | A1 | 4/2011 | Broden et al. | |
| 2012/0067242 | A1 * | 3/2012 | Shin et al. | 102/364 |

FOREIGN PATENT DOCUMENTS

| | | | |
|---|---|---|---|
| DE | 197 17 530 | A1 | 11/1998 |
| GB | 16 398 | | 10/1914 |
| GB | 103 891 | | 2/1917 |
| GB | 104 374 | | 2/1917 |
| GB | 104 545 | | 3/1917 |
| GB | 484 730 | | 5/1938 |
| WO | 2005/098344 | A1 | 10/2005 |
| WO | 2011/019695 | A1 | 2/2011 |
| WO | 2011/044126 | A2 | 4/2011 |

* cited by examiner

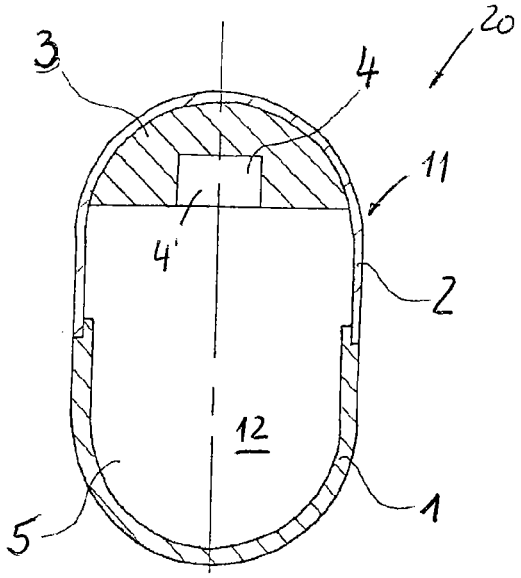
a)
Fig. 1
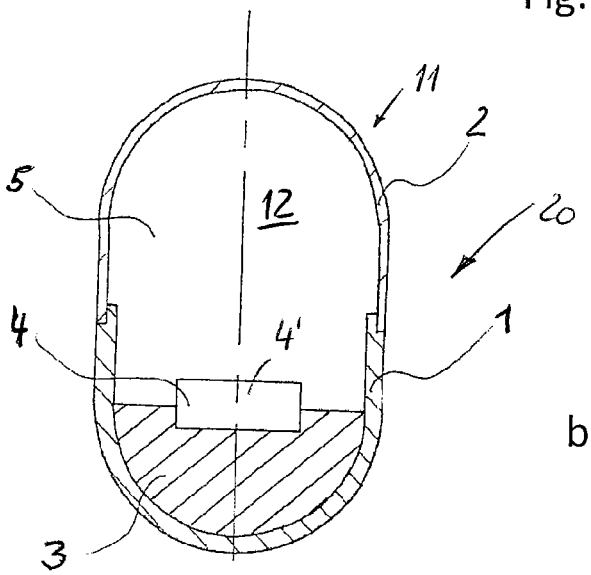
b)

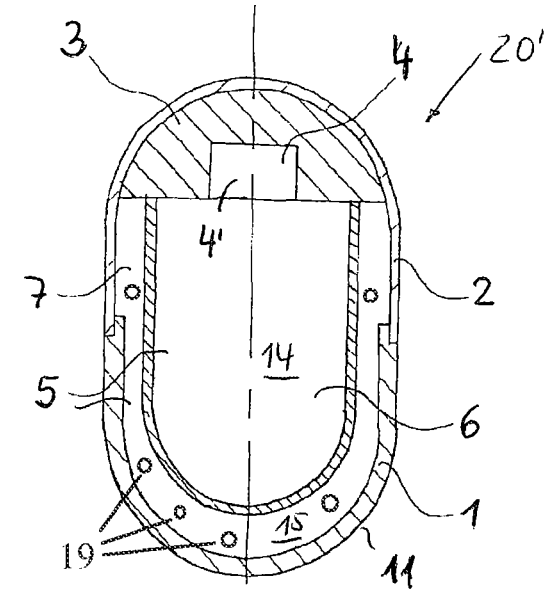
a)
Fig. 2
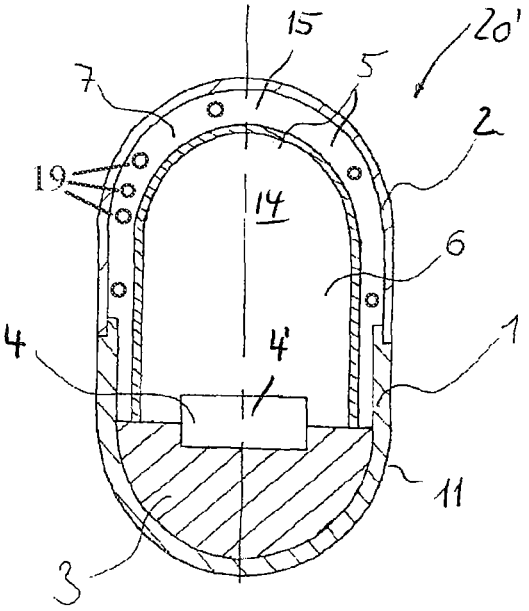
b)

AMMUNITION WITH PROJECTILE CONTAINING NO EXPLOSIVE MATERIAL IN ORDER TO CREATE A MULTI-SPECTRAL TARGET SIGNATURE

This is a non-provisional application claiming priority on provisional Application No. 61/760,819, filed Feb. 5, 2013, and German Patent Application No. DE 10 2012 023 700.6, filed Dec. 5, 2012. The entire disclosures of the above patent applications are hereby incorporated by reference.

FIELD OF THE INVENTION

The invention concerns an ammunition with a projectile containing no explosive material, which releases a flammable air-fuel mixture when being dismantled at the target. Said mixture is caused to spontaneously react by at least one explosive-free, spark-producing ignition mechanism triggered during impact dismantling. The thus produced optical and thermal target signature can be detected with the naked eye and or with other auxiliary means such as rifle-scopes or other optical systems that can protect fight vehicles from homing missiles, as well as with night vision and thermal imaging devices.

BACKGROUND OF THE INVENTION

Availability of small, efficient target detection systems results in growing measure in their deployment in the area of infantry weapons such as for example machine-guns or grenade launchers. For training of modern armed forces this results in a corresponding need for suitable ammunition for launcher devices and grenade weapons, portable mortars and shoulder-launchable charges. On the part of the Armed Forces, such ammunition is basically to be given preference for which, in addition to optical perceptibility in the visible range of light, detection is also possible by means of night-vision and/or thermal imaging devices for distances of up to approximately 1500 m.

Pyrotechnical ammunitions based on flash/"boom" effect are suitable for training purposes for visual-optical and acoustical perception, as well as for detection by means of night-vision and thermal imaging devices. One drawback of such pyrotechnical ammunitions is their potential danger by the explosive itself contained in the missiles, as well as by clearing the training areas, which are contaminated by unexploded shells.

During the previous decades, this led to the development of training ammunitions with explosive-free missiles. The visual-optical perceptibility in said type of ammunitions is attained, for example, by the release of colored dust on dismantling at time of impact. For detectability with night-vision devices, appropriate ammunitions were developed which utilize chemo-luminescent effects. The combination of colored dusts and marker units with chemo-luminescent effect ultimately made possible the supply of uniform trainings-ammunitions with explosive-fee missiles for training by day and training by night.

With US 2011/0079164 A1 or WO 2011/044126 A2, a 40 mm training ammunition is proposed for use, among others, in grenade launchers. It has an explosive-free missile, in which is integrated in the area of the missile top a fragile pay-load module. The pay-load module is filled with different materials, or in case of a therein integrated ampoule, with different combinations of materials in order to attain various effects. The lay-out of the ammunition is designed in such manner that it can be provided with different pay-load modules, while construction of the drive, the missile body with substance insert and the missile cover remain the same. In order to attain a visual-optical effect for day-time training, utilization is proposed of coloring substances in powder form or in granulated form or of coloring solutions or in gel-form. If a pay-load module with integrated ampoule is used, it is additionally possible to attain a detectable effect with night-vision and/or thermal imaging devices. In order to attain an effect which is detectable with thermal imaging devices, it is suggested to use a pyrophoric material in the form of powder or in granular form. As a result of combining coloring material and phosphoric material, it is possible to produce a visual-optical and at least by thermal imaging detectable effect.

WO 2011/019695 A1 discloses another 40 mm training ammunition for use, among others, in grenade launchers. Said explosive-free missile has, analogous to the existing "day-time and night-time marking" ammunitions, colored dust for "day-time marking" as well as an encapsulated chemo-luminescent effect for "night-time marking". As opposed to the known state of the art, a 'heat Engine" is being proposed here which is integrated in the base of the missile and generates encapsulated thermal energy, said "heat engine" being initiated by the firing load, and which is to heat up, directly or indirectly—via a thermal transfer medium—the chemo-luminescent effect, so that it is detectable at the point of impact dismantling by means of night-vision and thermal imaging devices. The encapsulated heat generated in the "heat engine" has the effect that with the use of pyrophoric materials for generating heat, these are not released and accordingly there is no risk of potential fire hazard. In addition to the use of pyrophoric materials, reactions of anhydrous salts with water or polymerization reactions of organic substances are also suggested for potential generation of thermal energy.

U.S. Pat. No. 7,055,438 B1 deals with ammunitions in calibers from 20 mm to 155 mm, which employ heat generating effect as "explosive-free luminous tracers" and/or long-term target marking—either alone or in combination with a chemo-luminescent effect. Examples are given here, among others, of reactions of (anhydrous) calcium chloride with water or a watery solution or metals in powder form with hydrogen-peroxide solutions. In order to attain longer-term marking effects, the solid matter substances are mixed with binding agents in powder form such as hydroxy-ethyl-cellulose or CAB, with the objective of forming during mixing with the liquid component or the liquid components a gelatinized, adhesive active mass.

With respect to the explosive-free training ammunitions being employed in the area of 40 mm grenade launchers, there currently exist two basic variations of the "day-time marking" by means of colored dusts released during impact, as well as the "day-time and night-time marking", where the missiles in addition to the colored dust release a chemo-luminescent effect, which is separately installed in the missile. Due to integration of the encapsulated chemo-luminescent effect in the missile, there results a correspondingly reduced colored dust volume, based on weighing, so that the required visual-optical visibility above 1000 m clearly decreases for 40 mm ammunitions, for example.

The possibility of integrating an additional effect for detection by means of thermal imaging devices can only be realized at the cost of detectability of the other effects. As a result, the effectively usable combat fight ranges in the training scenarios become greatly reduced. While this, perhaps, may still suffice for simple firing exercises at close range, a more reality-like combat training is no longer possible with this type of ammunition, e.g. in connection with grenade launchers and/or machine guns on combat vehicles.

All training ammunitions being employed or proposed are, ultimately, based on the original variation of the training ammunition with explosive-free missile with colored dust effect and have the objective of increasing functionality by integration of additional effects. The reduction based on weight of integration of an additional effect or additional effects, is accompanied by a more or less decrease of the effectively usable firing range of the training ammunition. By way of progression, variation or expansion of the preceding mode of action, a solution is not possible relative to the objects on which the invention is based.

The invention is based on the object of providing an ammunition with an explosive-free missile, which generates at dismantling within the target a multi-spectral signature which can be detected with the naked eye or with technical aids, such as rifle-scopes or other optical target detection systems, night-vision and thermal imaging devices.

SUMMARY OF THE INVENTION

According to the invention, this object is achieved by the features of first embodiment directed to an ammunition with an explosive-free missile (20, 20', 30, 30', 40), with at least one missile body (1, 42) and a missile cover (2, 43) as well as a support structure (3, 44), characterized in that the support structure (3) accepts an explosive-free ignition mechanism (4, 8, 9, 10, 16, 17, 18, 45) and a hollow space (5, 46) formed in the missile (20, 20', 30, 30', 40) serves for acceptance of an active mass (12, 14, 15, 47) which consists of a fuel or a fuel mixture, which is released with dismantling at the target as flammable air-fuel mixture, which is spontaneously brought to reaction by the explosive-free, spark-producing ignition mechanism (4, 8, 9, 10, 16, 17, 18, 45) by utilizing the firing energy and/or the kinetic energy. Further, particularly advantageous refinements of the invention are disclosed in the following additional embodiments. For example, in accordance with a second embodiment of the present invention, the first embodiment is modified so that at least one of the components of the ignition mechanism (4) consists of a spark-generating metal or a spark-generating metal alloy or a spark-generating ceramic, whereby the forces occurring during impact dismantling can be used directly for spark generation by at least two reciprocally movable components. In accordance with a third embodiment of the present invention, the second embodiment is modified so that the spark-generating metal or the spark-generating metal alloy constitute suitable materials such as magnesium, cer-ferrous alloys (Auermetal I), cer-ferrous-lanthan alloys (Auermetal II) or Auermetal III, etc.

In accordance with a fourth embodiment of the present invention, the first embodiment is modified so that the ignition mechanism (4, 45) comprises at least one component of a piezo-electrical ignition mechanism made of a non-conductive material or a non-conductive ferro-electrical material or a material with permanent electrical dipole, concerning which the forces occurring during impact dismantling are indirectly used for spark-generation by making use of the piezo-electrical effect. In accordance with a fifth embodiment of the present invention, the fourth embodiment is modified so that the suitable ceramic materials therefore are synthetic, inorganic, ferro-electric and/or polycrystalline ceramics, such as lead-zircon-titanate or barium-titanate.

In accordance with a sixth embodiment of the present invention, the first embodiment, the second embodiment, the third embodiment, the fourth embodiment or the fifth embodiment is modified so that the active mass (12, 14, 47) constitutes a fuel in powder-, granular or compressed form, or a fuel mixture in powder-, granular or compressed form. In accordance with a seventh embodiment of the present invention, the first embodiment, the second embodiment, the third embodiment, the fourth embodiment, the fifth embodiment or the sixth embodiment is modified so that that the fuel or fuel mixture is surrounded by a secondary active mass (15) which is spatially separated from the fuel or fuel mixture by means of an insert in the missile (20, 20'). In accordance with an eighth embodiment, the seventh embodiment is modified so that the secondary active mass (15) is a powder-shaped or granulated or compressed active mass with open-flame damping and/or energy-absorbing/moderating properties, which forms, at impact-dismantling point, around the flammable air-fuel mixture (14) an open flame damping and/or energy absorbing cloud, which, in turn, can detectably radiate the absorbed energy. In accordance with a ninth embodiment, the seventh embodiment or the eighth embodiment is modified so that an addition is provided of an inorganic pigment and/or an inorganic colored substance, which creates at impact dismantling an additional visual-optical effect in the form of a colored dust effect.

In accordance with a tenth embodiment of the present invention, the first embodiment, the second embodiment, the third embodiment, the fourth embodiment, the fifth embodiment, the sixth embodiment, the seventh embodiment, the eighth embodiment, or the ninth embodiment is modified so that the ignition mechanism (4, 45) consists of a bolt (8), made of a spark-generating material or material mixture, which in turn is surrounded by a piston (9). In accordance with an eleventh embodiment of the present invention, the first embodiment, the second embodiment, the third embodiment, the fourth embodiment, the fifth embodiment, the sixth embodiment, the seventh embodiment, the eighth embodiment, or the ninth embodiment is modified so that the ignition mechanism (4, 45) comprises an electronic assembly (16) under which is positioned a piston (17).

In accordance with a twelfth embodiment of the present invention, the first embodiment, the second embodiment, the third embodiment, the fourth embodiment, the fifth embodiment, the sixth embodiment, the seventh embodiment, the eighth embodiment, the ninth embodiment, the tenth embodiment or the eleventh embodiment is modified so that the ignition mechanism (4) comprises a safety device (4', 10, 18) for protection against premature, unintended triggering, which releases the ignition mechanism (4), making use of the centrifugal force, the centripetal force, the Coriolis force of the acceleration or deceleration of the missile (20, 20', 30, 30', 40) or the mass inertia of the individual components of the missile (20, 20', 30, 30', 40) or of the safety device (4', 10, 18, 45') or a combination of the named forces.

The invention is therefore based on the fundamental concept of creating an explosive-free missile, which, with dismantling within the target releases a fuel or fuel mixture in the form of a flammable air-fuel mixture, which, in turn, is spontaneously realized by at least one explosive-free, spark-producing ignition mechanism, triggered at impact dismantling. The multi-spectral signature, generated with the reaction of the flammable air-fuel mixture, can be detected during the day or at night with the naked eye or with technical aids, such as rifle-scopes or other optical target detection systems, as well as with night-vision and thermal imaging devices.

In order to produce the desired effects/signatures in the training ammunition, only one single effect mass is needed, which, moreover, compared with phosphoric materials or chemo-luminescence producing liquid multi-component systems, does not require more complex encapsulation, but also does not exclude same. Consequently, comparatively larger amounts of active material based on weight can be realized and connected therewith, greater effectively usable combat fighting ranges.

The proposed invention-specific ammunition has the benefit that by means at least one safety measure of the ignition mechanism, it can be designed to be manipulation- and application-secure. An unintended, premature triggering effect in ammunitions for machine guns is therefore to be excluded, inasmuch as the safety device of the ignition mechanism for twist-stabilized missiles becomes unlocked only by the forces occurring at firing and the safety device then releases the ignition mechanism. Therefore the proposed invention-specific ammunition concept can also be utilized for mechanically greatly stressed ammunitions for machine guns in the caliber range from 20 mm to 50 mm. In addition to the safety device of the ignition mechanism, the transport-, handling- and application safety also increases by the absence of substances and mixtures of substances in the missile in the form of powder.

By comparison with the use of ammunitions with 'heat engine" integrated in the missile, the proposed, invention-specific invention additionally provides the benefit that the multi-spectral signature is generated directly with impact dismantling within the target and is therefore largely independent of the temperature and the firing distance.

It is possible to obtain with the proposed, invention-specific ammunition an almost true to nature signature comparable with the corresponding HE combat ammunitions or pyro-technical flash-boom ammunitions. In contrast to the HE combat ammunitions or the pyro-technical flash-boom ammunitions, a reality-close training can be guaranteed with the proposed, invention-specific ammunition with corresponding risk due to unexploded, explosive-containing shells. Depending upon the employed fuel or fuel-mixture, a non-reacted effective mass generally does not present a risk comparable with an explosive-containing unexploded shell. Flammability only exists during a brief window of time at the point of impact dismantling under formation of an air-fuel mixture. Depending upon the utilized fuel or fuel mixture, possible fuel residues can either simply weather on the training grounds or can be collected and disposed of without problem.

Fuels or fuel mixtures integrated into ammunitions for the generation of flash- and or glare effects are thus far only initiated via dismantling charges of explosive (e.g. flash-light bombs for reconnaissance photography) or pyro-technical mixtures (various non-lethal weapons and ammunitions). The concept of the explosive-free creation of a multi-spectral signature with ammunitions comprising explosive-free missiles is not known until now and can be realized in ammunitions with caliber range from 20 mm to 50 mm for grenade launchers and grenade machine weapons, in ammunitions with caliber range from 20 mm to 50 mm for machine guns, in ammunitions ranging in caliber from 40 mm to 81 mm in launching systems, in ammunitions ranging in caliber from 50 mm to 120 mm for mortars, in sub-caliber ammunitions for mortars, in ammunitions for anti-tank missiles (Panzerfaust) and shoulder-fired loads, in sub-caliber ammunitions for anti-tank missiles and shoulder-fired loads, as well as in anti-tank- and in artillery ammunitions. In addition to the use of the proposed invention-specific ammunition as training ammunition for reality-close training, the training ammunition can also find application as "warning shot with optical signature", as non-lethal ammunition or also as anti-material ammunition.

The multi-spectral signatures to be attained by means of the proposed invention-specific invention can be controlled by the selection of the fuel or fuel mixture, the utilized grain sizes and the weight-based volume. The relevant control possibilities of the multi-spectral signature, which is to be attained, are comparatively larger for the proposed invention-specific invention than for ammunitions having several effective masses arranged separately in the missile in order to attain a corresponding signature. For example, the duration of the multi-spectral signature can be prolonged with the use of aluminum powder in pyrolytic grinding finish quality grade, by addition of an alloy of aluminum and magnesium or by addition of aluminum filters of corresponding grain sizes.

The additionally attained visual-optical effect of smoke development during combustion of the fuel or the fuel mixture can likewise be influenced by the selection of the fuel or the fuel mixture. For example, the formation of smoke can be increased by use of an aluminum powder in pyrolytic grinding finish quality grade, by addition of red phosphorous (white smoke) or by addition of an organic fuel, e.g. naphthalene (whitish-gray to somewhat black smoke). If smoke development is unwelcome, this can be counter-acted by the selection of the fuel or the fuel mixture. For example, if an aluminum powder in pyrolytic grinding finish quality grade is used, smoke development can be reduced by addition of lycopodium (a mixture of natural organic compounds obtained from plants or plant components) or total substitution of the aluminum powder with lycopodium.

The following may be selected as fuel:

- aluminum or an aluminum alloy or boron or cerium or iron or ferrosilicon or a magnesium alloy or magnesium or an alloy of magnesium or manganese or molybdenum or red phosphorous or sulfur or silicon or titanium or titanium-hydride or tungsten or zirconium or zirconium-hydride or a zirconium-ferrous alloy or a mixture of same,
- or a synthetic organic compound or a mixture of synthetic organic compounds,
- or a mixture of organic compounds obtained from plants and plant components,
- or a mixture of aluminum or an aluminum alloy or boron or cerium or iron or ferrosilicon or magnesium or a magnesium alloy or manganese or molybdenum or red phosphorous or sulfur or silicon or titanium or titanium-hydride or tungsten or zirconium or zirconium-hydride or a zirconium-iron alloy or a mixture of same with a synthetic organic compound or a mixture of synthetic organic compounds,
- or a mixture of aluminum or an aluminum alloy or boron or cerium or iron or ferrosilicon or magnesium or a magnesium alloy or manganese or molybdenum or red phosphorous or sulfur or silicon or titanium or titanium-hydride or tungsten or zirconium or zirconium-hydride or a zirconium-iron alloy or a mixture of same with a mixture of organic compounds obtained from plants or plant components.

The ignition mechanism comprises at least one of the components of a spark generating metal alloy or a spark generating ceramic. As the most suitable materials are specified here magnesium, cerium-ferro alloys (Auermetal I), cerium-iron-lanthanum alloys (Auermetal II), or Auermetal III, without restricting the preferred invention-specific embodiments of the ammunition to these examples. The forces which occur during impact dismantling are directly used for generating sparks by means of at least two counter-mobile components.

An ignition mechanism can alternatively be integrated, which indirectly utilizes the forces occurring at impact dismantling by making use of the piezo-electrical effect. The latter comprises at least one component of the piezo-electric ignition mechanism from a non-conductive material or a non-conductive ferro-electrical material or a material with permanent electrical dipole. As suitable materials are specified here ceramics produced with synthetic, inorganic, ferro-electrical and poly-crystalline ceramic materials, such as lead-zirconate-titanate or barium-titanate, without limiting the preferred invention-specific embodiments of the ammunition to these examples.

For reduction of fire risk which exists due to the generation of open light and heat during reaction of the generated air-fuel mixture upon impact dismantling, the preferred invention-specific embodiments of the ammunition with explosive-free missile, the therein arranged fuel or fuel mixture can be enveloped with an additional, secondary effective mass, which is spatially separated by an insert from the fuel or the fuel mixture. Said secondary effective mass, upon impact dismantling, forms around the flammable air-fuel mixture an open flame and/or energy absorbing or damping cloud, which, in turn can radiate in detectable manner the absorbed energy. Additionally, another, visual-optical effect in the form of the colored dust may be integrated in the secondary effective mass.

In all corresponding invention-specific embodiments, the secondary effective mass consists of:

- an inorganic and/or organic fire suppressant mixture, or
- an inorganic pigment and/or inorganic alloy, or
- an inorganic pigment and/or an inorganic alloy and an organic color substance, or
- a mixture of an inorganic and/or organic fire suppressant mixture with an inorganic pigment and/or an inorganic alloy and or an organic coloring substance.

As examples of inorganic fire suppressants are specified: ammonium phosphate, ammonium hydrogen-phosphate, phosphates and hydrogen-phosphates of the alkaline and alkaline earth metals, ammonium sulfate, ammonium hydrogen sulfate, the sulfates of the alkaline and alkaline earth metals, as well as the carbonates and hydrogen carbonates of the alkaline and alkaline earth metals, without limiting the preferred invention-specific embodiments of the ammunition to these examples.

As examples of inorganic pigments and alloys are specified; iron oxides, aluminum-bronzes and brass, without limiting the preferred invention-specific embodiments of the ammunition to these examples.

BRIEF DESCRIPTION OF THE DRAWINGS

The invention is to be explained in more detail based on an exemplary embodiment with drawing.

FIG. 1 shows a first specific embodiment of ammunition with an explosive-free missile FIGS. 2-5 show additional specific embodiments.

DETAILED DESCRIPTION OF THE INVENTION

Figure 3:
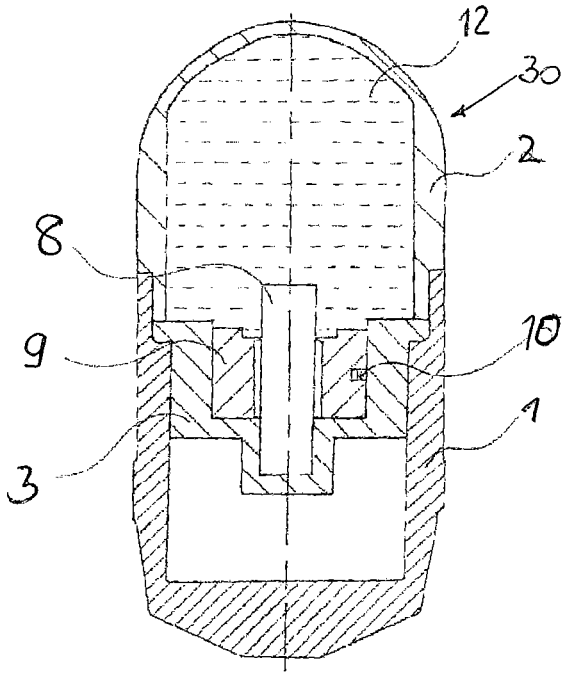

In a first embodiment according to FIG. 1, the ammunition with an explosive-free missile 20 comprises a missile casing 1, consisting of at least a missile body 1 and a missile cover 2. The missile casing 1 is integrated with a support structure 3—either in the missile cover 2 in FIG. 1*a* or in missile body 1 in FIG. 1*b*—for an ignition mechanism 4 with safety device 4'. The support structure 3 with the ignition mechanism 4 with safety device 4' is arranged in the missile casing 1 at the top or the bottom. In dormant position the safety device 4' arrests the ignition mechanism 4. The forces which occur as a result of firing unlock the safety device 4' and release the ignition mechanism 4. The hollow space 5 formed by missile body 1, missile cover 2 and support structure 3 with ignition mechanism 4 and safety device 4' serves for acceptance of a missile effective mass 12.

The ammunition depicted in FIG. 2 with an explosive-free missile 20' corresponds more or less to the ammunition according to FIG. 1, with the difference that the hollow space 5 which is formed by the missile body 1, the missile cover 2 and the support structure 3 with ignition mechanism 4 and safety device 4' is divided (sub-divided) into at least two chambers. The interior chamber 6 serves for acceptance of a primary missile active mass 14. The primary active mass 14 is a powder shaped or granulated or compressed fuel or fuel mixture. The outer chamber 7 serves for acceptance of a secondary missile active mass 15. The secondary active mass 15 is a powder shaped or granulated or compressed active mass with open-flame damping and/or energy absorbing/moderating properties and generates an additional visual-optical effect upon addition of an inorganic pigment and/or an inorganic alloy and/or an organic color substance 19 at time of impact dismantling. With impact of the missile 20' on a potential target, the developing deceleration force causes a triggering of the ignition mechanism 4, whereby the mechanical energy is directly used for generation of sparks by friction and/or impact, or whereby due to utilization of the piezo-electrical effect, sparks are indirectly generated. The air-fuel mixture generated during the impact dismantling is ignited by the simultaneously produced sparks of the ignition mechanism 4, resulting in an optical and thermal target signature. The secondary effective mass cloud which is generated concurrently at time of impact dismantling around the flammable air-fuel mixture serves,—depending upon composition of the secondary effective mass 15,—for generating an added visual-optical signature and/or for shielding and for protection of the environment versus the primarily generated thermal effect.

FIG. 3 depicts a preferred invention-specific embodiment of a twist-stabilized missile 30. The missile 30 of the ammunition consists of a missile cover 2 and a missile body 1, into which is built a support structure 3 for the mechanical ignition mechanism comprising a bolt 8, a piston 9 and also a safety mechanism 10. Said support structure accepts the bolt 8, made of a spark-generating material or material mixture, which, in turn is surrounded by the piston 9. The latter, in dormant position is arrested by the safety mechanism 10, and is not uncoupled until immediately after firing, making use of centrifugal force, thus releasing the piston, which is now moved forward from its dormant position onto a potential target by means of the acting deceleration force which influences missile 30, and ensures, in the same step by mechanical contact with bolt 8 made of spark generating material or material mixture, the formation of one or several ignition sparks, which, in turn ignite in the form of an air-fuel mixture the active mass 12 released upon impact of missile 30 and break-up of missile cover 2.

Figure 4:
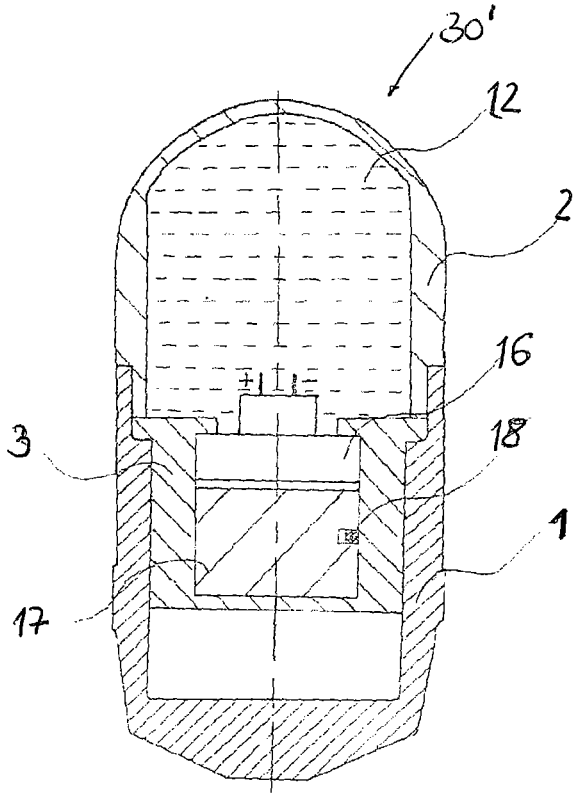

FIG. 4 depicts another preferred invention-specific embodiment of a twist-stabilized missile 30'. The missile 30' of the ammunition consists of missile cover 2 and missile body 1, into which is installed a support structure 3 for the ignition mechanism. The support structure accepts an electronic assembly 16, under which is positioned a piston 17 which is arrested, in dormant position, by means of a safety mechanism 18, which is not uncoupled until immediately after firing, making use of centrifugal force, thus releasing piston 17, which is now moved forward from its dormant position by means of the acting deceleration force impacting on missile 30, onto a potential target, and which axially deforms, in the same step, the in this case, piezo-electrical ignition mechanism, whereby electrical tension is produced, generating by means of two electrodes, one or several ignition sparks, which, in turn ignite the released active mass 12 in form of an air-fuel mixture upon impact of missile 30' and bursting apart of the missile cover 2.

Figure 5:
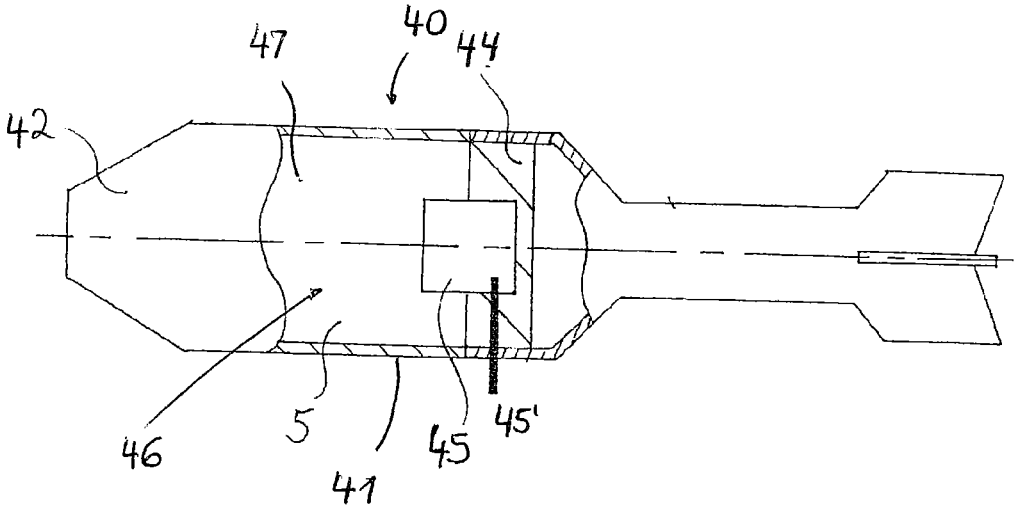

FIG. 5 depicts another embodiment of ammunitions with an explosive-free, wing-stabilized missile 40, the missile consists of a missile casing comprising at least one missile body 41 and a missile cover 42, into which is integrated a support structure 44 for ignition mechanism 45 with safety device 45'. The support structure 44 with the ignition mechanism 45 with safety device 45' is arranged in this case at the top and bottom inside missile 40. The safety device 45' is preferably manually unblocked prior to firing. The safety device 45' is for example either a drawing splint or a rotary drawing splint or a spring-positioned bolt with bayonet lock. The hollow space 46, formed by missile body 41, missile cover 42 and support structure 44 with ignition mechanism 45 with safety device 45', serves for acceptance of an active missile mass 47. The active mass 47 contained in missile 40 is a fuel in powder form or granulated or compressed, or a fuel mixture in the form of a powder, or granulated or compressed. With impact of missile 40 onto a potential target, the developing deceleration force causes triggering of the ignition mechanism 45, whereby the mechanical energy, resulting from friction and/or impact, is used directly for the generation of sparks, or whereby sparks are indirectly produced by making use of the piezo-electrical effect. The air-fuel mixture generated during impact dismantling is ignited by the concurrently generated sparks of the ignition mechanism 45, thus creating an optical and thermal target signature.

The invention claimed is:

1. An ammunition with an explosive-free missile comprising:

(a) a missile comprising (i) at least one missile body;

(ii) a missile cover;

(iii) a support structure;

(b) an explosive-free, spark-producing ignition mechanism, wherein the support structure holds the ignition mechanism within the missile body; and (c) an active mass, wherein the active mass is located in a hollow space that is defined within the missile, wherein the active mass comprises a fuel or a fuel mixture that is releasable at impact dismantling at a target as a flammable air-fuel mixture, wherein the flammable air-fuel mixture is disposed at impact dismantling to be spontaneously brought to reaction by the explosive-free, spark-producing ignition mechanism, wherein the active mass comprises a fuel in powder, granular or compressed form, or a fuel mixture in powder, granular or compressed form, and wherein the ignition mechanism is armed by one of the group consisting of a firing energy of the missile, a kinetic energy of the missile, and the firing energy and the kinetic energy of the missile.

2. The ammunition according to claim 1, wherein the ignition mechanism comprises at least two reciprocally movable components, wherein the at least two reciprocally movable components are disposed to directly cause spark-generation via forces occurring during impact dismantling, and wherein at least one component comprises a spark-generating metal or a spark-generating metal alloy or a spark-generating ceramic.

3. The ammunition according to claim 2, wherein the spark-generating metal or the spark-generating metal alloy comprise at least one of magnesium, cerium-ferrous alloys, cerium-ferrous-lanthanum alloys or Aurmetal III.

4. The ammunition according to claim 1, wherein the ignition mechanism comprises at least one component of a piezo-electrical ignition mechanism, wherein the at least one component of the piezo-electrical ignition mechanism is disposed to indirectly cause spark-generation via a piezo-electrical effect caused by forces occurring during impact dismantling, and wherein the at least one component comprises a non-conductive material or a non-conductive ferro-electrical material or a material with a permanent electrical dipole.

5. The ammunition according to claim 4, wherein the non-conductive material or the non-conductive ferro-electrical material or the material with a permanent electrical dipole comprise at least one of synthetic ceramics, inorganic ceramics, ferro-electric ceramics or poly-crystalline ceramics.

6. The ammunition according to claim 5, wherein the poly-crystalline ceramics are lead-zircon-titanate or barium-titanate.

7. The ammunition according to claim 1, further comprising:

(e) a secondary active mass; and (f) an insert disposed in the hollow space, wherein the fuel or fuel mixture of the active mass is surrounded by the secondary active mass, and wherein the secondary active mass is spatially separated from the active mass by the insert.

8. The ammunition according to claim 7, wherein the secondary active mass is a powder-shaped or granulated or compressed active mass with open-flame damping or energy-absorbing or energy-moderating properties or open-flame damping and energy-absorbing properties, or open-flame damping and energy-moderating properties, wherein, at an impact-dismantling point, the secondary active mass forms an open-flame damping or energy-absorbing or open-flame damping and energy-absorbing cloud that is disposed around the flammable air-fuel mixture of the active mass, and wherein the cloud around the flammable air-fuel mixture detectably radiates any absorbed energy.

9. The ammunition according to claim 7, wherein the secondary active mass further comprises an inorganic pigment or an inorganic colored substance or an inorganic pigment and an inorganic colored substance, wherein the inorganic pigment or the inorganic colored substance or the inorganic pigment and the inorganic colored substance are disposed to create, at impact dismantling, a visual-optical effect, and wherein the visual-optical effect is a colored dust effect.

10. The ammunition according to claim 1, wherein the ignition mechanism comprises a bolt that is surrounded by a piston, and wherein the bolt comprises a spark-generating material or a spark-generating material mixture.

11. The ammunition according to claim 1, wherein the ignition mechanism comprises an electronic assembly and a piston, and wherein the piston is positioned under the electronic assembly.

12. The ammunition according to claim 1, wherein the ignition mechanism comprises a safety device that prevents premature, unintended triggering of the ignition mechanism, wherein the safety device releases the ignition mechanism via a centrifugal force, a centripetal force, a Coriolis force of an acceleration or deceleration of the missile, or a mass inertia of individual components of the missile or the safety device, or a combination of the centrifugal force, the centripetal force and the Coriolis force of the acceleration or deceleration of the missile.

* * * * *